US012655597B2

(12) United States Patent
Wang et al.

(10) Patent No.: US 12,655,597 B2
(45) Date of Patent: Jun. 16, 2026

(54) GROUTING DOUBLE-LOCKING PRESSURE REAL-TIME SENSING SYSTEM AND METHOD FOR OPERATING THE SAME

(71) Applicant: SAFEKEY Engineering Technology (Zhengzhou), Ltd., Zhengzhou (CN)

(72) Inventors: Fuming Wang, Zhengzhou (CN); Peng Zhao, Zhengzhou (CN); Hongyuan Fang, Zhengzhou (CN); Yanhui Pan, Zhengzhou (CN); Hui Liu, Zhengzhou (CN); Xianfeng Zhao, Zhengzhou (CN)

(73) Assignee: SAFEKEY Engineering Technology (Zhengzhou), Ltd., Zhengzhou (CN)

( * ) Notice: Subject to any disclaimer, the term of this patent is extended or adjusted under 35 U.S.C. 154(b) by 428 days.

(21) Appl. No.: 18/209,497

(22) Filed: Jun. 14, 2023

(65) Prior Publication Data

US 2023/0323621 A1 Oct. 12, 2023

(30) Foreign Application Priority Data

Sep. 30, 2022 (CN) ..... 202211206674.8

(51) Int. Cl.

*E02D 15/04* (2006.01)
*E02D 5/54* (2006.01)
*E02D 5/64* (2006.01)

(52) U.S. Cl.

CPC ..... *E02D 15/04* (2013.01); *E02D 5/64* (2013.01); *E02D 2600/10* (2013.01); *E02D 2600/30* (2013.01)

(58) Field of Classification Search

CPC .. E02D 3/12; E02D 15/04; E02D 5/64; E21B 33/13

See application file for complete search history.

(56) References Cited

U.S. PATENT DOCUMENTS 2,631,435 A * 3/1953 Emshwiller ..... E02D 5/54 405/244

FOREIGN PATENT DOCUMENTS

CN 107503740 A * 12/2017 ..... E21B 47/06
CN 114541376 A * 5/2022 ..... E02D 5/56
KR 101737067 B1 * 5/2017 ..... G06Q 50/08

* cited by examiner

*Primary Examiner* — Amber R Anderson
*Assistant Examiner* — Stacy N Lawson

(57) ABSTRACT

A grouting double-locking pressure real-time sensing system includes: a positioning structure fixed to a ground; wherein an expandable positioning structure passes through the positioning structure, and an input end of the expandable positioning structure is connected to the grouting structure; the pressure real-time monitoring component is connected to the expandable positioning structure; the expandable positioning structure comprises a hollow conduit, an expandable assembly, an upper positioning member, and a lower positioning member; wherein the upper positioning member and the lower positioning member are respectively connected to two ends of the expandable assembly; the hollow conduit passes through the upper positioning member and the lower positioning member, and is threaded to the lower positioning member; the upper positioning member is fixed to the positioning structure; when rotating the hollow conduit, the lower positioning member moves up and down, so as to expand or contract the expandable assembly.

16 Claims, 2 Drawing Sheets

GROUTING DOUBLE-LOCKING PRESSURE REAL-TIME SENSING SYSTEM AND METHOD FOR OPERATING THE SAME

CROSS REFERENCE OF RELATED APPLICATION

The present invention claims priority under 35 U.S.C. 119(a-d) to CN 202211206674.8, filed Sep. 30, 2022.

BACKGROUND OF THE PRESENT INVENTION

Field of Invention

The present invention relates to a technical field of geotechnical engineering grouting, and more particularly to a grouting double-locking pressure real-time sensing system and a method for operating the same.

Description of Related Arts

With the rapid development of China's economy, a large number of new infrastructures have been constructed and stocks are becoming larger and larger. For example, the mileage of road projects is increasing significantly every year, and the number of tunnels and other underground infrastructures are also increasing. Due to improper design and construction or maintenance, defects will gradually appear, such as cracks in concrete structure, road debris and cavities, sinking of pipes, and settlement of high-speed railroad track plates, which seriously affect the engineering safety and people's daily life. Such defects often need to be repaired, and grouting, as a non-excavation method, is commonly used for treatment.

The conventional grouting device, as disclosed in Chinese patent application 202110948644.3, Slurry controllable rotating grouting head and grouting method with patent number, cuts the soil body by rotating the grouting head, so as to form a controlled cavity in the pile body. Compared with traditional grouting, such grouting device effectively overcomes the shortcomings such as the slurry flow is not easy to control and the slurry utilization rate is low. However, for reinforced uplift defect treatment, high-pressure grouting is often used, which has high requirements for the solid connection of the grouting device. The conventional inserted grouting head or grouting device with a simple sleeve cannot meet the requirements of high-pressure grouting, nor can it monitor the supply pressure and the pressure in the hole during the grouting process, nor can it monitor the pressure change in the hole after grouting. As a result, the construction has great blindness and may cause secondary damage to the structure, leading to uncertain repairing quality.

SUMMARY OF THE PRESENT INVENTION

An object of the present invention is to provide a grouting double-locking pressure real-time sensing system and a method for operating the same, thereby solving the problems of locking and pressure monitoring of high-pressure grouting.

Accordingly, in order to accomplish the above object, the present invention provides a grouting double-locking pressure real-time sensing system, comprising: a positioning structure, an expandable positioning structure, a pressure real-time monitoring component, and a grouting structure;

wherein the positioning structure is fixed to a ground; the expandable positioning structure passes through the positioning structure, and an input end of the expandable positioning structure is connected to the grouting structure; the pressure real-time monitoring component is connected to the expandable positioning structure for monitoring a pressure in a grouting hole and a supply pressure of a grouting equipment, which also feeds information to a receiving end;

the expandable positioning structure comprises a hollow conduit, an expandable assembly, an upper positioning member, and a lower positioning member; wherein the upper positioning member and the lower positioning member are respectively connected to two ends of the expandable assembly; the hollow conduit passes through the upper positioning member and the lower positioning member, and is threaded to the upper positioning member and the lower positioning member; the upper positioning member is fixed to the positioning structure; when rotating the hollow conduit, the lower positioning member moves up and down, so as to expand or contract the expandable assembly.

The upper positioning member and the lower positioning member are nuts, and the upper positioning member is fixed to the positioning structure to increase stability. When the hollow conduit moves downwards, the lower positioning member moves upwards and gets close the upper positioning member, thus making the expandable assembly expand and vice versa. The expansion state forms a bolt in the hole for internal locking.

Preferably, the expandable assembly comprises multiple strips having bendable central portions, and the strips are made of a rigid material.

Preferably, the expandable assembly comprises two the strips symmetrically arranged with respect to the hollow conduit, and the strips are made of iron or high-density polyethylene.

Preferably, the hollow conduit is connected to the grouting structure by a screw cap.

Preferably, the positioning structure comprises a positioning plate and a through-hole opened in a middle of the positioning plate; a connection hole is drilled on the positioning plate, so as to connecting the positioning plate to the ground by a connection member; the expandable positioning structure passes through the through-hole.

The positioning plate is either round or square. The connection member is a locking bolt, which fixes the positioning plate on the ground, making the upper positioning member fixed to the positioning plate stable, thus ensuring the stability of the expandable positioning structure and the stability during a high-pressure grouting process. At the same time, the positioning plate can also seal a perimeter of the grouting hole, preventing slurry leakage and ensuring grouting effect.

Preferably, the upper positioning member passes through the through hole and is fixed to the positioning plate.

Preferably, the pressure real-time monitoring component comprises a pressure sensor and a computer communicating with the pressure sensor; the pressure sensor is placed on the hollow conduit for monitoring the supply pressure of the grouting equipment and the pressure in the grouting hole during grouting. The pressure sensor comprises a first sensor set inside the hollow conduit for monitoring the supply pressure of the grouting equipment during grouting and a second sensor set outside the hollow conduit for monitoring the pressure inside the grouting hole during grouting. Both the first sensor and the second sensor communicate with the computer.

The pressure sensor is connected to the computer, which can monitor the supply pressure of the grouting equipment during grouting in real time, as well as the pressure inside the grouting hole in real time. The pressure sensor can also monitor pressure change inside the structure after grouting.

The pressure sensor can monitor the supply pressure of the grouting equipment during grouting in real time, as well as the pressure inside the grouting hole in real time. The pressure sensor can also monitor pressure change inside the structure after grouting.

Preferably, a one-way switch is arranged on the hollow conduit. The pressure is placed below the one-way switch.

Preferably, the grouting structure comprises a grouting machine and a grouting pipe connected to an output end of the grouting machine; the grouting pipe is connected to the hollow conduit; and a grouting switch is arranged on the grouting conduit.

Preferably, a thread direction of the upper positioning member is the same as that of the lower positioning member, which ensures that when the hollow conduit moves downwards along the upper positioning member, the lower positioning member will move upwards and get close to the upper positioning member, so as to expand the expandable assembly; and when the hollow conduit moves upwards along the upper positioning member, the lower positioning member moves downwards to straighten the expandable assembly.

Preferably, a thread pitch of the upper positioning member is smaller than that of the lower positioning member, which allows the lower positioning member to move a longer distance than the upper positioning member on the hollow conduit, so that the expandable assembly can expand or contract faster. A periphery of the hollow conduit with which the upper positioning member and the lower positioning member are threaded is provided with a thread pitch to fit the upper positioning member and the lower positioning member.

The present invention also provides a method for operating the above grouting double-locking pressure real-time sensing system, comprising steps of:

- step 1: drilling the grouting hole at a predetermined location, installing the positioning structure, and fixing the positioning structure to the ground by a connection member;
- step 2: passing the upper positioning member of the expandable positioning structure through the positioning structure, and fixing the upper positioning member to the positioning structure, wherein the expandable positioning structure is in a contracted state;
- step 3: rotating the hollow conduit to move the lower positioning member upwards, in such a manner that a bottom end of the expandable assembly moves upwards to form an outwardly expanded structure, which increases a friction with the grouting hole for internal locking; and
- step 4: connecting the grouting structure to the hollow conduit for grouting.

Preferably, in the step 1, the grouting hole is drilled at the predetermined location, and the grouting hole should be deep enough to defect areas according to a technical solution, and should be cleaned.

Preferably, in the step 4, the grouting structure is connected to the hollow conduit, then the one-way switch and the grouting switch are turned on for grouting.

Beneficial effect of the present invention: the present invention has reasonable design and compact structure, wherein the pressure sensors are located inside and outside the hollow conduit, which can monitor the pressure in the grouting hole during grouting and the internal pressure of the structure after grouting in real time, so as to monitor grouting status. At the same time, external fixation of the positioning structure cooperates with expansion of the internal expandable positioning structure to form a double-locking structure, which solves the problem of excessive internal pressure during high-pressure grouting and excessive grouting, thereby preventing the grouting pipe from sliding off and ensuring the grouting effect.

The positioning plate is either round or square. The connection member is a locking bolt, which fixes the positioning plate on the ground, making the upper positioning member fixed to the positioning plate stable, thus ensuring the stability of the expandable positioning structure and the stability during a high-pressure grouting process. At the same time, the positioning plate can also seal a perimeter of the grouting hole, preventing slurry leakage and ensuring grouting effect.

The pressure sensor is connected to the computer, which can monitor the supply pressure of the grouting equipment during grouting in real time, as well as the pressure inside the grouting hole in real time. The pressure sensor can also monitor pressure change inside the structure after grouting.

Element reference: 1—positioning structure, 2—expandable positioning structure, 3—pressure real-time monitoring component, 4—grouting structure, 5—one-way switch, 6—grouting switch, 21—hollow conduit, 22—expandable assembly, 23—upper positioning member, 24—lower positioning member, 11—positioning plate, 12—through hole, 13—connection hole, 31—pressure sensor, 32—computer, 41—grouting machine, 42—grouting pipe.

DETAILED DESCRIPTION OF THE PREFERRED EMBODIMENT

The present invention will be further illustrated below in conjunction with preferred embodiments. Other advantages and effects of the present invention can be readily appreciated by those skilled in the art through the disclosure herein. The present invention may also be implemented or applied through different embodiments, and details in this specification may be modified or changed in various ways based on different views and applications without departing from the spirit of the present invention.

It should be noted that the structure, proportions, size, and other features illustrated in the accompanying drawings are only used to match the contents disclosed in the specification, which are exemplary for those skilled in the art to understand and read, and are not intended to be limiting. Therefore, the drawings do not have a substantial technical significance. Any structure modification, proportional change or dimensional adjustment, without affecting the efficacy of the present invention and the purpose it can achieve, should still fall within the scope of the technical content revealed by the present invention. At the same time, terms in this specification such as “top”, “bottom”, “left”, "right", "center" and "middle" are only for the clarity of the narrative, but not for limiting the scope of the present invention. Any change or adjustment of their relative relationship, without substantial change of the technical content, should still fall within the scope of the present invention.

Embodiment 1

Figure 1:
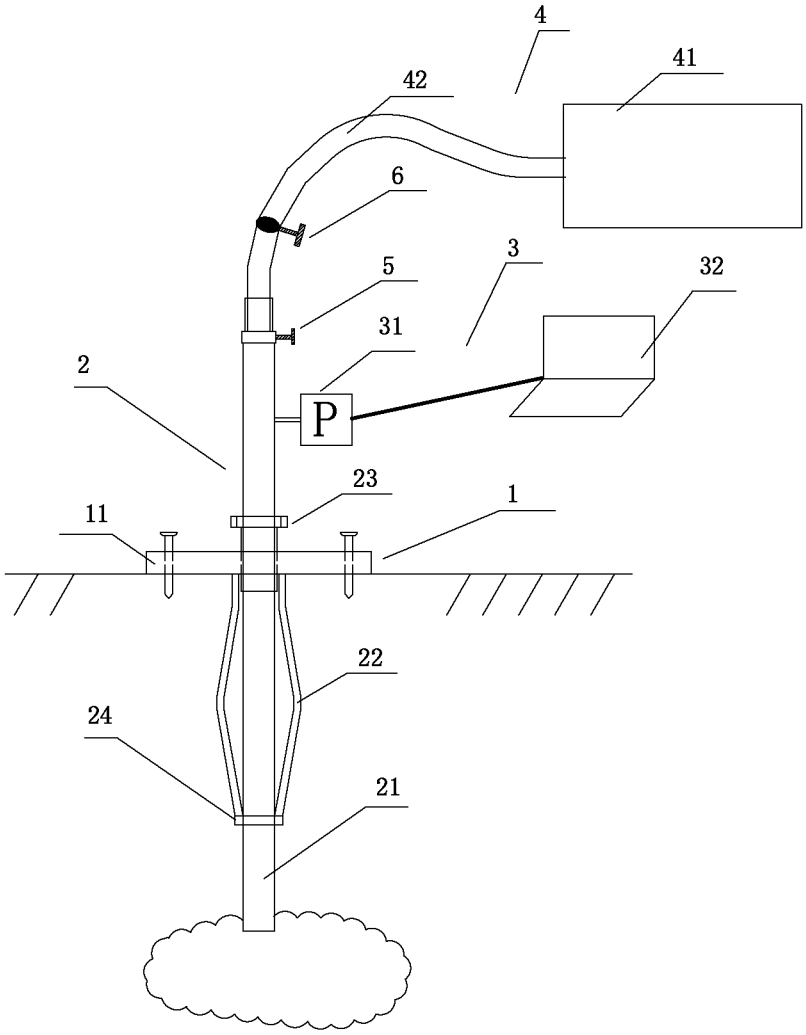
FIG. 1 is a structural view of a grouting double-locking pressure real-time sensing system according to the present invention.
Figure 2:
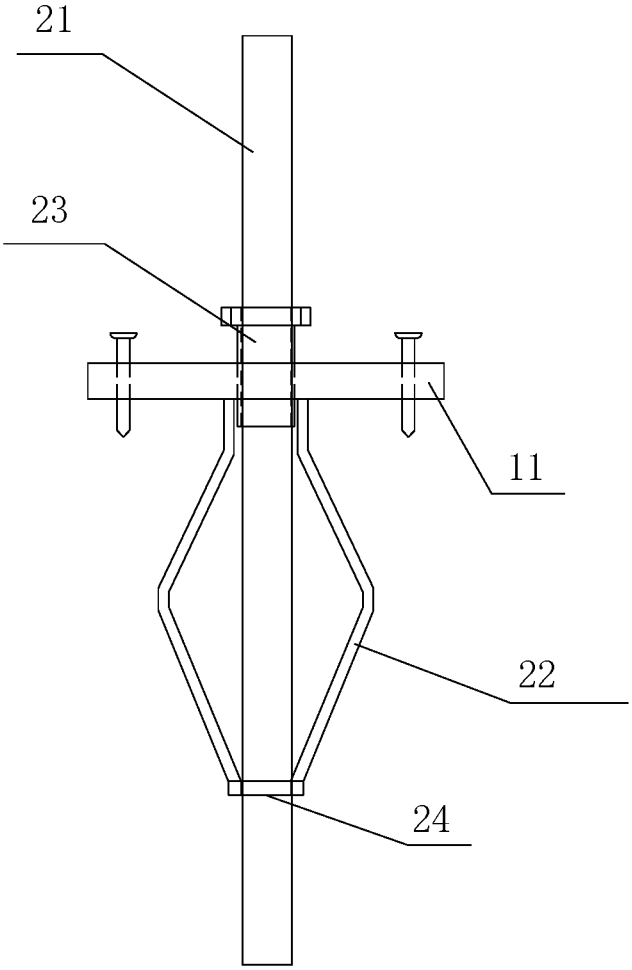
FIG. 2 is a structural view of an expandable positioning structure according to the present invention.
Figure 3:
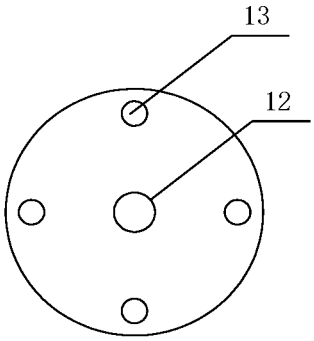
FIG. 3 is a structural view of a positioning structure according to the present invention.

Referring to FIGS. 1-3, a grouting double-locking pressure real-time sensing system is provided, comprising:

a positioning structure 1, an expandable positioning structure 2, a pressure real-time monitoring component 3, and a grouting structure 4; wherein the positioning structure 1 is fixed to a ground; the expandable positioning structure 2 passes through the positioning structure 1, and an input end of the expandable positioning structure 2 is connected to the grouting structure 4; the pressure real-time monitoring component 3 is connected to the expandable positioning structure 2 for monitoring a pressure in a grouting hole and a supply pressure of a grouting equipment, which also feeds information to a receiving end;

the expandable positioning structure 2 comprises a hollow conduit 21, an expandable assembly 22, an upper positioning member 23, and a lower positioning member 24; wherein the upper positioning member 23 and the lower positioning member 24 are respectively connected to two ends of the expandable assembly 22; the hollow conduit 21 passes through the upper positioning member 23 and the lower positioning member 24, and is threaded to the upper positioning member 23 and the lower positioning member 24; the upper positioning member 23 is fixed to the positioning structure 1; when rotating the hollow conduit 21, the lower positioning member 24 moves up and down, so as to expand or contract the expandable assembly 22.

The upper positioning member and the lower positioning member are nuts, and the upper positioning member is fixed to the positioning structure to increase stability. When the hollow conduit moves downwards, the lower positioning member moves upwards and gets close the upper positioning member, thus making the expandable assembly expand and vice versa. The expansion state forms a bolt in the hole for internal locking.

According to the embodiment 1, the expandable assembly 22 comprises multiple strips having bendable central portions, and the strips are made of a rigid material.

Preferably, the expandable assembly 22 comprises two the strips symmetrically arranged with respect to the hollow conduit 21, and the strips are made of iron or high-density polyethylene.

According to the embodiment 1, the hollow conduit 21 is connected to the grouting structure 4 by a screw cap.

According to the embodiment 1, the positioning structure 1 comprises a positioning plate 11 and a through-hole 12 opened in a middle of the positioning plate 11; a connection hole 13 is drilled on the positioning plate 11, so as to connecting the positioning plate 11 to the ground by a connection member; the expandable positioning structure 2 passes through the through-hole 12.

Preferably, the positioning plate is either round or square. The connection member is a locking bolt, which fixes the positioning plate on the ground, making the upper positioning member fixed to the positioning plate stable, thus ensuring the stability of the expandable positioning structure and the stability during a high-pressure grouting process. At the same time, the positioning plate can also seal a perimeter of the grouting hole, preventing slurry leakage and ensuring grouting effect.

According to the embodiment 1, the upper positioning member 23 passes through the through hole 12 and is fixed to the positioning plate 11.

According to the embodiment 1, the pressure real-time monitoring component 3 comprises a pressure sensor 31 and a computer 32 communicating with the pressure sensor 31; the pressure sensor 31 is placed on the hollow conduit 21 for monitoring the supply pressure of the grouting equipment and the pressure in the grouting hole during grouting. The pressure sensor comprises a first sensor set inside the hollow conduit for monitoring the supply pressure of the grouting equipment during grouting and a second sensor set outside the hollow conduit for monitoring the pressure inside the grouting hole during grouting. Both the first sensor and the second sensor communicate with the computer.

The pressure sensor is connected to the computer, which can monitor the supply pressure of the grouting equipment during grouting in real time, as well as the pressure inside the grouting hole in real time. The pressure sensor can also monitor pressure change inside the structure after grouting.

The pressure sensor can monitor the supply pressure of the grouting equipment during grouting in real time, as well as the pressure inside the grouting hole in real time. The pressure sensor can also monitor pressure change inside the structure after grouting.

According to the embodiment 1, a one-way switch 5 is arranged on the hollow conduit 21. The pressure is placed below the one-way switch.

According to the embodiment 1, the grouting structure 4 comprises a grouting machine 41 and a grouting pipe 42 connected to an output end of the grouting machine 41; the grouting pipe 42 is connected to the hollow conduit 21; and a grouting switch 6 is arranged on the grouting conduit 42.

According to the embodiment 1, a thread direction of the upper positioning member is the same as that of the lower positioning member, which ensures that when the hollow conduit moves downwards along the upper positioning member, the lower positioning member will move upwards and get close to the upper positioning member, so as to expand the expandable assembly; and when the hollow conduit moves upwards along the upper positioning member, the lower positioning member moves downwards to straighten the expandable assembly.

According to the embodiment 1, a thread pitch of the upper positioning member is smaller than that of the lower positioning member, which allows the lower positioning member to move a longer distance than the upper positioning member on the hollow conduit, so that the expandable assembly can expand or contract faster. A periphery of the hollow conduit with which the upper positioning member and the lower positioning member are threaded is provided with a thread pitch to fit the upper positioning member and the lower positioning member.

Working principles of the present invention are as follows: firstly, drilling the grouting hole at a predetermined location, and fixing the positioning structure to the ground; then passing the expandable positioning structure through the through hole of the positioning structure, so as to enter the grouting hole; fixing the upper positioning member to the positioning structure, and rotating the hollow conduit to outwardly expand the expandable assembly, which realizes internal locking of the grouting hole; connecting a top of the hollow conduit to the grouting pipe of the grouting structure through a nut, turning on the grouting switch and the one-way switch on the hollow conduit for grouting with a grouting machine; at this time, monitoring the grouting pressure and the pressure in the grouting hole in real time with the pressure sensor, and transmitting the information to the computer, in such a manner that the staff can adjust grouting conditions according to the feedback information on the computer, thereby ensuring the grouting effect.

Embodiment 2

The embodiment 2 provides a method for operating the above grouting double-locking pressure real-time sensing system, comprising steps of:

step 1: drilling the grouting hole at a predetermined location, installing the positioning structure 1, and fixing the positioning structure 1 to the ground by a connection member;

wherein the grouting hole is drilled at the predetermined location, and the grouting hole should be deep enough to defect areas according to a technical solution, and should be cleaned;

step 2: passing the upper positioning member 23 of the expandable positioning structure 2 through the positioning structure 1, and fixing the upper positioning member 23 to the positioning structure 1, wherein the expandable positioning structure 2 is in a contracted state;

step 3: rotating the hollow conduit 21 to move the lower positioning member 24 upwards, in such a manner that a bottom end of the expandable assembly 22 moves upwards to form an outwardly expanded structure, which increases a friction with the grouting hole for internal locking; and step 4: connecting the grouting structure 4 to the hollow conduit 21 for grouting.

According to the embodiment 2, in the step 1, the grouting hole is drilled at the predetermined location, and the grouting hole should be deep enough to defect areas according to a technical solution, and should be cleaned.

According to the embodiment 2, in the step 4, the grouting structure 4 is connected to the hollow conduit 21, then the one-way switch and the grouting switch are turned on for grouting.

The above description is only preferred embodiments of the present invention, and is not intended to be limiting. Any modifications, equivalent replacements and improvements made within the spirit and principles of the present invention shall be included in the protection scope of the present invention.

What is claimed is:

1. A grouting double-locking pressure real-time sensing system, comprising: a positioning structure (1), an expandable positioning structure (2), a pressure real-time monitoring component (3), and a grouting structure (4); wherein the positioning structure (1) is fixed to a ground; the expandable positioning structure (2) passes through the positioning structure (1), and an input end of the expandable positioning structure (2) is connected to the grouting structure (4); and the pressure real-time monitoring component (3) is connected to the expandable positioning structure (2) for monitoring a pressure in a grouting hole and a supply pressure of a grouting equipment, wherein the pressure real-time monitoring component (3) also feeds information to a receiver; and wherein the expandable positioning structure (2) comprises a hollow conduit (21), an expandable assembly (22), an upper positioning member (23), and a lower positioning member (24); wherein the upper positioning member (23) and the lower positioning member (24) are respectively connected to two ends of the expandable assembly (22); the hollow conduit (21) passes through the upper positioning member (23) and the lower positioning member (24), and is threaded to the upper positioning member (23) and the lower positioning member (24); the upper positioning member (23) is fixed to the positioning structure (1); a thread direction of the upper positioning member is the same as that of the lower positioning member; a thread pitch of the upper positioning member is smaller than that of the lower positioning member; portions of the hollow conduit with which the upper positioning member and the lower positioning member are threaded are provided with thread pitches to fit the upper positioning member and the lower positioning member; and when rotating the hollow conduit (21), the lower positioning member (24) moves up and down, so as to expand or contract the expandable assembly (22).

2. The grouting double-locking pressure real-time sensing system, as recited in claim 1, wherein the expandable assembly (22) comprises multiple strips having bendable central portions, and the strips are made of a rigid material.

3. The grouting double-locking pressure real-time sensing system, as recited in claim 2, wherein the expandable assembly (22) comprises two of the strips symmetrically arranged with respect to the hollow conduit (21), and the strips are made of iron or high-density polyethylene.

4. The grouting double-locking pressure real-time sensing system, as recited in claim 3, wherein the hollow conduit (21) is connected to the grouting structure (4) by a screw cap.

5. The grouting double-locking pressure real-time sensing system, as recited in claim 3, wherein the positioning structure (1) comprises a positioning plate (11) and a through-hole (12) in a middle of the positioning plate (11); a connection hole (13) is drilled in the positioning plate (11), so as to connect the positioning plate (11) to the ground by a connection member; and the expandable positioning structure (2) passes through the through-hole (12).

6. The grouting double-locking pressure real-time sensing system, as recited in claim 5, wherein the upper positioning member (23) passes through the through hole (12) and is fixed to the positioning plate (11).

7. The grouting double-locking pressure real-time sensing system, as recited in claim 3, wherein the pressure real-time monitoring component (3) comprises a pressure sensor (31) and a computer (32) communicating with the pressure sensor (31); and the pressure sensor (31) is placed on the hollow conduit (21) for monitoring the supply pressure of the grouting equipment and the pressure in the grouting hole during grouting.

8. The grouting double-locking pressure real-time sensing system, as recited in claim 3, wherein a one-way switch (5) is arranged on the hollow conduit (21).

9. The grouting double-locking pressure real-time sensing system, as recited in claim 3, wherein the grouting structure (4) comprises a grouting machine (41) and a grouting pipe (42) connected to an output end of the grouting machine (41); the grouting pipe (42) is connected to the hollow conduit (21); and a grouting switch (6) is arranged on the grouting pipe (42).

10. The grouting double-locking pressure real-time sensing system, as recited in claim 1, wherein the hollow conduit (21) is connected to the grouting structure (4) by a screw cap.

11. The grouting double-locking pressure real-time sensing system, as recited in claim 1, wherein the positioning structure (1) comprises a positioning plate (11) and a through-hole (12) in a middle of the positioning plate (11); a connection hole (13) is drilled in the positioning plate (11), so as to connect the positioning plate (11) to the ground by a connection member; and the expandable positioning structure (2) passes through the through-hole (12).

12. The grouting double-locking pressure real-time sensing system, as recited in claim 11, wherein the upper positioning member (23) passes through the through hole (12) and is fixed to the positioning plate (11).

13. The grouting double-locking pressure real-time sensing system, as recited in claim 1, wherein the pressure real-time monitoring component (3) comprises a pressure sensor (31) and a computer (32) communicating with the pressure sensor (31); and the pressure sensor (31) is placed on the hollow conduit (21) for monitoring the supply pressure of the grouting equipment and the pressure in the grouting hole during grouting.

14. The grouting double-locking pressure real-time sensing system, as recited in claim 1, wherein a one-way switch (5) is arranged on the hollow conduit (21).

15. The grouting double-locking pressure real-time sensing system, as recited in claim 1, wherein the grouting structure (4) comprises a grouting machine (41) and a grouting pipe (42) connected to an output end of the grouting machine (41); the grouting pipe (42) is connected to the hollow conduit (21); and a grouting switch (6) is arranged on the grouting conduit pipe (42).

16. A method for operating the grouting double-locking pressure real-time sensing system as recited in claim 1, comprising steps of:

step 1: drilling the grouting hole at a predetermined location, installing the positioning structure (1), and fixing the positioning structure (1) to the ground by a connection member;

step 2: passing the upper positioning member (23) of the expandable positioning structure (2) through the positioning structure (1), and fixing the upper positioning member (23) to the positioning structure (1), wherein the expandable positioning structure (2) is in a contracted state;

step 3: rotating the hollow conduit (21) to move the lower positioning member (24) upwards, in such a manner that a bottom end of the expandable assembly (22) moves upwards to form an outwardly expanded structure, which increases a friction with the grouting hole for internal locking; and step 4: connecting the grouting structure (4) to the hollow conduit (21) for grouting.

* * * * *